United States Patent [19]

Rossmann et al.

[11] Patent Number: 4,695,396

[45] Date of Patent: Sep. 22, 1987

[54] TWO-COMPONENT ALKALINE CLEANING COMPOSITIONS AND METHODS OF PREPARING AND USING SAME

[75] Inventors: Christian Rossmann, Langenfeld; Horst Fluechter, Kaarst; Gerald Schreiber, Duesseldorf; Winfried Wichelhaus, Mettmann, all of Fed. Rep. of Germany

[73] Assignee: Henkel Kommanditgesellschaft auf Aktien, Duesseldorf, Fed. Rep. of Germany

[21] Appl. No.: 827,291

[22] Filed: Feb. 7, 1986

[30] Foreign Application Priority Data

Feb. 7, 1985 [DE] Fed. Rep. of Germany ..... 3504172

[51] Int. Cl.[4] ..... C11D 11/00

[52] U.S. Cl. ..... 252/135; 252/136; 252/315.6

[58] Field of Search ..... 252/135, 136, 140, 315.6; 134/40

[56] References Cited

U.S. PATENT DOCUMENTS

| | | | |
|---|---|---|---|
| 2,992,997 | 7/1961 | Arden et al. | 252/156 |
| 3,527,608 | 9/1970 | Schlussler | 134/2 |
| 3,553,016 | 1/1971 | Foelsch | 252/142 |
| 3,715,324 | 2/1973 | Hynes et al. | 252/135 |
| 3,823,094 | 7/1974 | Lanez | 252/90 |
| 3,997,460 | 12/1976 | Sirine et al. | 252/106 |
| 4,200,548 | 4/1980 | Sundén et al. | 252/135 |
| 4,521,332 | 6/1985 | Milora | 252/135 |
| 4,597,888 | 7/1986 | King | 252/135 |

FOREIGN PATENT DOCUMENTS 3246080 6/1984 Fed. Rep. of Germany .

*Primary Examiner*—Paul Lieberman
*Assistant Examiner*—Willie J. Thompson
*Attorney, Agent, or Firm*—Henry E. Millson, Jr.; Mark A. Greenfield; Real J. Grandmaison

[57] ABSTRACT

The invention relates to alkaline cleaners containing two components A and B, component A being a strongly alkaline solution comprising mostly alkali metal hydroxides and employed in an excess, component B being a concentrate comprising an aqueous silicic acid dispersion containing anionic, nonionic or amphoteric tensides, builder substances, stabilizers and optionally inorganic mineral acids, complexing agents and/or preservatives. Component B contains, as an active ingredient, adjusted to a pH in the range of from 1 to 11, a silicic acid dispersion obtained in situ by treating an alkali metal silicate solution with a mineral acid or a gas reacting acidically in aqueous solution. The dispersions also contain stabilizers, tensides and builder substances. If desired, additional agents conventionally contained in cleaning concentrates may also be added. The invention also relates to processes for preparing such cleaners by treating an alkali metal silicate solution with a mineral acid or a gas reacting acidically in aqueous solution and adding tensides, stabilizers and builder substances thereto.

18 Claims, No Drawings

TWO-COMPONENT ALKALINE CLEANING COMPOSITIONS AND METHODS OF PREPARING AND USING SAME

BACKGROUND OF THE INVENTION

1. Field of the Invention

The present invention relates to concentrates for alkaline two-component cleaners and methods of preparing and using same. More particularly, the invention relates to a method of making stable concentrates for alkaline two-component cleaners containing a silicic acid dispersion, tensides, stabilizers and optionally a high concentration of builder salts.

2. Description of Related Art

Alkaline cleaning agents are used for cleaning rigid materials such as, for example, work pieces made of metal or glass. These cleaning agents contain sodium hydroxide, orthophosphates, condensed phosphates, silicates, complexing agents, wetting agents and, optionally, corrosion inhibitors, anti-foaming agents and preservative. In general, products containing these components are commercially available as powders which are added to the cleaning bath. The concentration of the cleaning agent in the bath is maintained between 0.1 and 20% by weight, depending on the particular use and amount of dirt accumulation.

It is very important for purposes of cleaning efficiency to maintain the optimum concentration of the cleaner constituents in the cleaning solution. This may be determined by titration or conductivity measurements, for example. Conductive measuring devices may be combined with an automatic metering device for adding the cleaning powder in order to maintain a desired concentration of the cleaner.

Unfortunately, the continuous trouble-free metered addition of these powders is very difficult to achieve, especially when the powders contain hygroscopic salts. Furthermore, nonionic tensides are sensitive to solid sodium hydroxide and during extended storage periods the tensides tend to oxidize and form ether carboxylic acids. When this occurs, the strength of the cleaner deteriorates and, in spray applications, undesirable foaming occurs.

In addition to powdered cleaning agents, liquid alkaline cleaning concentrates are also known. U.S. Pat. No. 3,527,608 discloses a way of preventing the loss of polymer phosphates during extended storage of alkaline cleaning concentrates due to hydrolysis and the poor compatibility of the nonionic wetting agents, the anti-foaming agents and the polymer phosphates with the residual cleaning concentrate. U.S. Pat. No. 3,527,608 discloses supplementing these cleaning concentrates with a liquid acidic concentrate containing nonionic wetting agents and/or anti-foaming agents. The concentrates also contain water-soluble organic acids or acidic salts thereof which form complexes with substances causing water hardness. These concentrates, which typically exhibit acidic or neutral reactions, are made into liquid cleaners exhibiting alkaline reactions by the addition of excess alkali. Unfortunately, silicate-containing cleaners cannot be prepared using this procedure since the tensides used are incompatible with high concentrations of builder substances in the solution.

Published German patent application No. 32 46 080 discloses cleaners or cleaning solutions containing two components, one of the components being a sodium hydroxide solution, the other component containing the remaining active cleaning ingredients. The latter component solution may be adjusted to an acidic or neutral pH value, an acidic pH being advantageous in that all of the constituents, and more specifically the tensides, are particularly well soluble. The disclosed two-component cleaners, more specifically, are characterized in that the acidic or neutral component is an aqueous dispersion of silicic acid prepared from pyrogenic or precipitated silicic acid, which dispersion may optionally contain further components such as phosphoric acid, sulfuric acid, polyphosphates, tensides, stabilizers and/or preservatives.

Published German patent application No. 32 46 080 discloses preparing the silicic acid dispersions by precipitating silicic acid from water glass using sulfuric acid, following by washing and drying of the precipitate. However, this process is very expensive and difficult to carry out on an industrial scale. Moreover, the silicic acid obtained by this process has a relatively poor solubility in application such as a concentrate for a two-component cleaner. Poor solubility occurs when the $SiO_2/Na_2O$ ratio in the cleaning bath is greater than 0.3:1. Another drawback in using precipitated and isolated silicic acid is, due to the limited solubilities of nonionic tensides, relatively strongly acidic concentrates must be prepared in order to ensure sufficient stabilization. This means that large amounts of alkali metal hydroxide must be added for neutralization or for achieving a preferred alkaline cleaning solution.

DESCRIPTION OF THE INVENTION

It has now been discovered that it is by no means necessary to isolate separately and dry the silicic acid precipitated from water glass with an acid. Highly active liquid two-component cleaning systems can now be obtained using silicic acid dispersions obtained in situ by precipitating the silicic acid, from sodium water glass or potassium water glass, with an acid, and by adding stabilizers, tensides and optionally other builder substances to the dispersions. Surprisingly, the salts formed during neutralization do not adversely affect the stability of the dispersions. Thus it is now possible to prepare stable and storable cleaning concentrates having pH values even in the alkaline range (up to pH 11).

Accordingly, the present invention relates to alkaline cleaning concentrates having components A and B. Component A comprises a strong alkaline solution containing mostly alkali metal hydroxides and is employed in an excess amount. Component B is a concentrate containing the remaining active cleaning ingredients, and comprises an aqueous silicic acid dispersion containing anionic, nonionic or amphoteric tensides; builder substances; stabilizers; and optionally, inorganic mineral acids, complexing agents and/or preservatives. Component B contains as an active ingredient, adjusted to a pH in the range of from 1 to 11, a silicic acid dispersion obtained in situ by treating an alkali metal silicate solution with a mineral acid or a gas reacting acidically in aqueous solution. The dispersions also contain stabilizers, tensides and builder substances. If desired, additional builder substances and other agents conventionally contained in cleaning concentrates may also be added.

The present invention also relates to methods of making alkaline cleaner compositions having components A and B. The methods are characterized by treating alkali metal silicate solutions with at least one of a mineral acid or a gas reacting acidically in aqueous solution, and further, by the addition of stabilizers and tensides to the silicic acid dispersions obtained thereby. If desired, additional builder substances and/or agents conventionally found in cleaning concentrates may also be added to the silicic acid dispersions.

The present invention further relates to cleaning rigid materials with alkaline two-component cleaners.

Suitable for the purposes of the present invention are aqueous alkali metal silicate solutions having a $SiO_2/M_2O$ weight ratio (M represents an alkali metal) in the range of from about 2 to 3.5. Sodium water glass solutions and potassium water glass solutions are substantially equally suitable. However, from cost and availability standpoints, aqueous sodium water glass solutions are preferred.

In one preferred embodiment of the present invention undiluted technical water glass solutions may be used. This has proven to be advantageous since the resulting concentrates are intended to have a high concentration of active ingredients. The use of dilute solutions requires further processing steps to be performed in order to increase the concentration of active ingredients to desirable levels. Examples of such additional processing steps include concentrating the dispersion by evaporation or filtration. These steps are advantageously avoided when concentrated solutions are employed.

The preparation of the silicic acid formed in situ is effected by the precipitation of silicic acid through the reaction of the water glass solution with a mineral acid or a gas reacting acidically in an aqueous solution. Examples of acidically reacting gases include HCl, $SO_2$ and $CO_2$. Among these gases, precipitation with $CO_2$ is preferred. As the mineral acid, phosphoric acid, sulfuric acid and mixtures thereof in a weight ratio of from about 3:1 to 1:3 are suitable. Particularly preferred is a mixture of phosphoric and sulfuric acids, having a weight ratio of about 1:1. In practice, concentrated acids are advantageously used in order to attain a high concentration of active ingredients in the resulting silicic acid dispersion.

During the precipitation reaction, the pH should be 8 to 11, preferably 8 to 10, and the reaction temperature should be between about 60° C. and 90° C. Under these conditions high grade silicic acids are obtained which produce particularly stable dispersions. The pH range as indicated may be conveniently maintained by operating in a buffer system. Particularly suitable buffers include the alkali metal salts of acids having anions which act as buffers in the pH range of from about 8 to 10, for example phosphates, carbonates and/or borates. The buffering salts, in aqueous solution, may be charged beforehand into the reactor for the precipitation reaction, or they may be formed in the course of the precipitation reaction.

When the silicic acid is precipitated from the alkali metal silicate solution with sulfuric acid, it has proven beneficial to first charge the desired amount of phosphate to be present in the concentrate into the reactor in the form of an aqueous solution and then to precipitate the silicic acid by simultaneously adding the water glass solution and the sulfuric acid.

Upon completion of the precipitation, the dispersion may be adjusted to the desired pH in the acidic, neutral or alkaline range. By adding excess mineral acid, a pH of 1 is attainable without adversely affecting the suitability of the dispersions in alkaline two-component cleaning concentrates. However, the dispersions are preferably adjusted to an alkaline pH of from about 8 to 11, by using aqueous sodium hydroxide solution, potassium hydroxide solution, sodium orthophosphate, potassium orthophosphate, sodium carbonate, potassium carbonate, sodium silicate and/or potassium silicate.

Builder salts (also referred to herein as builder substances) are beneficial in the cleaning concentrates of the present invention. The salts may be either formed in situ during the precipitation reaction or may be added as buffers. Builder salts are salts which enhance the cleaning effect of the tensides. Examples of builder salts include the orthophosphates, polyphosphates, carbonates, borates and/or sulfates of alkali metals. More specifically, alkali metal polyphosphates, i.e. alkali metal pyrophosphates and/or tripolyphosphates, may advantageously be used as builder salts.

In order to achieve good cleaning properties, it is desirable to add tensides to the silicic acid dispersion. For this purpose anionic, nonionic and/or amphoteric tensides are suitable. Specifically, compounds such as alkylbenzene sulfonates, alkyl sulfonates, fatty alcohol sulfates, addition products of ethylene oxide and/or propylene oxide to fatty alcohols, fatty amines, alkyl phenols and surface active ethylene oxide/propylene oxide block polymers may be mentioned. The chain lengths of the alkyl groups in said compounds may be from 8 to 20 carbon atoms and in the case of alkyl phenols from 6 to 18 carbon atoms. Suitable amphoteric tensides include compounds such as alkyldimethylammonium betaines containing from 12 to 18 carbon atoms in the alkyl residue.

In a preferred embodiment of the present invention the precipitation of the silicic acid from the alkali metal silicate solution by means of a mineral acid may be effected in the presence of said tenside(s). This procedure in particular facilities stabilization of alkaline dispersions containing nonionic tensides.

In addition, the silicic acid dispersion component of the concentrates of the present invention may contain complexing agents, such as for example alkali metal salts of nitrilotriacetic acid, ethylenediaminetetraacetic acid, gluconic acid, citric acid or phosphonic acid (e.g. hydroxyethane-1,1-diphosphonic acid, aminotrimethylenephosphonic acid and 2-phosphono-1,2,4-butanetricarboxylic acid).

As a stabilizer, there may be used compounds which prevent sedimentation of the silicic acid in the dispersion. For example, one or more substances selected from vegetable gum (i.e. xanthan) and the copolymers of polyalkylvinyl ethers and carboxylic acid anhydrides may be used. Specific examples include copolymers of polymethylvinylether and maleic anhydride sold by GAG Corporation, Wayne, N.J., under the trademark "GANTREZ" AN.

The concentrate component B having the active ingredients contains from 10 to 26% by weight, preferably from 15 to 25% by weight, and more preferably from 18 to 22% by weight of silicic acid, calculated as $SiO_2$; from 5 to 27% by weight, preferably from 8 to 25% by weight, and more preferably from 13 to 24% by weight of builder substances; from 0.5 to 12% by weight, preferably from 1 to 10% by weight, and more preferably from 1 to 8% by weight of tensides; from 0.2 to 5% by weight, preferably from 0.3 to 3% by weight, and more preferably from 0.5 to 2% by weight of stabilizers; and from 0.5 to 10% by weight, preferably from 1 to 8% by weight, and more preferably from 2 to 7% by weight of complexing agents.

The alkaline component A of the two-component cleaners may comprise a sodium hydroxide solution, a potassium hydroxide solution or mixtures thereof. Additional compounds which are incompatible with the silicic acid dispersion component may be used, such as, for example, lignin sulfonates. The aqueous alkali metal hydroxide solution is used in excess quantities in the two-component cleaners of the present invention. The term "excess amount", when referring to the amount of component A in the alkaline two-component cleaners, denotes a sufficient amount of alkali metal hydroxide solution to give the cleaner, after mixing components A and B, a pH greater than 11, and preferably greater than 12. For example, about 2 parts by weight of a 50% alkali metal hydroxide solution may be added to about 1 part by weight of a 20% $SiO_2$ component B dispersion to achieve an alkaline cleaning concentrate having a pH above 11. Other mixing ratios may be determined through routine experimentation and may vary widely depending upon the concentration of active ingredients in components A and B.

In order to prepare the two-component cleaning solutions, the components A and B are mixed in water warmed to at least 40° C. whereby the silicic acid of component B reacts with the highly alkaline component A forming water-soluble silicates. Due to the excess amount of component A used, pH values greater than 12 are easily attained.

One advantage of using the concentrates (i.e., component B) of the present invention, whereby silicic acid is precipitated in situ, is that the dispersions have greatly improved solubility compared with dispersions known from the prior art. Another advantage in using concentrates, whereby silicic acid is precipitated in situ, is that greater flexibility in formulating the concentrates with additional components is provided. Thus, for example, the use of alkaline salts as builders is now possible. In addition, compared with known two-component cleaners, a savings in the amount of alkali metal hydroxides used is realized when the pH of the component B is adjusted to within 8 to 11. The reason for this is that neutralization of strongly acidic components, using large excesses of alkali metal hydroxides, is no longer required.

Another advantage of the present invention is that the step of washing the precipitated silicic acid, which on an industrial scale is troublesome and expensive, and the steps of separation from the precipitation solution and of drying the isolated silicic acid, all become unnecessary. It is a further advantage of the invention that high salt concentrations impair neither the stability of the silicic acid dispersions nor the efficiency of the resulting two-component cleaners.

Although certain embodiments of the invention have been selected for description in the examples hereinafter, it will be appreciated by those skilled in the art that these examples are merely illustrative of, but do not in any way limit, the scope of the present invention which is defined in the appended claims.

EXAMPLE 1

To 8 l of a 2% disodium hydrogenphosphate solution there were simultaneously added, in metered rates at 80° C. using two metering pumps, 35 kg of sodium water glass adjusted to a $SiO_2/Na_2O$ weight ratio of 3.3 and a total solids content of 35% and 4.7 kg of a mixture of 98% sulfuric acid and 85% phosphoric acid in a ratio by weight of 1:1 so that the pH was always maintained within the range of from 8 to 9. To the suspension there were added 1.0% of xanthan as stabilizer, 2% of an addition product of 14 moles of ethylene oxide (EO) to one mole of nonylphenol and 1% of alkylbenzene sulfonic acid. The dispersion had a pH of 8.5. By adding 5 kg of sodium water glass the pH was raised to 10.4 while the dispersion remained stable.

EXAMPLE 2

To 8 l of a 10% solution triphosphate solution there were simultaneously added, in metered rates at 70° C., 40 kg of potassium water glass adjusted to a $SiO_2/K_2O$ weight ratio of 2.1 and a total solids content of 40% and 6 kg of 98% sulfuric acid so that the pH was maintained between 8 and 9. To the suspension there were added 1.5% of xanthan as a stabilizer, 2% of an addition product of 14 EO to a $C_{12-18}$ fatty alcohol and 1% of alkylbenzene sulfonic acid.

EXAMPLE 3

In a reactor equipped with a stirrer there were added to 5 l of a 2% disodium hydrogenphosphate solution, 60 g of alkylbenzene sulfonic acid, and 240 g of an addition product of 14 moles of ethylene oxide to nonylphenol. The mixture was heated to 80° C. To this solution there were simultaneously added in metered rates 3.8 kg of a mixture of 98% sulfuric acid and 85% phosphoric acid in a ratio by weight of 3:1 and 40 kg of sodium water glass having a $SiO_2/Na_2O$ weight ratio of 3.3 and a density of 1.35 g/cm$^3$ so that the pH was maintained within the range of from 8.8 to 9.2. After completion of the reaction, a dispersion having a pH of 9.1 was formed. 0.3% of a stabilizer composition, comprising xanthan and a co-polymer based on polymethylvinylether/maleic anhydride ("GANTREZ" AN 149), was added to the dispersion.

EXAMPLE 4

This example illustrates the improved solubility of silicic acid precipitated in situ over commercially available precipitated silicic acid.

In a cleaning bath containing about 5% sodium hydroxide solution and 1% silicic acid, the time required for complete dissolution of the silicic acid at 60° C. was measured for two types of silicic acid:

| | |
|---|---|
| (a) silicic acid precipitated in situ (obtained in Example 1 and stored for 3 months) | complete dissolution after 4 minutes; |
| (b) precipitated silicic acid FK TM 320 (sold by Degussa, Inc., Chemicals Division, New York) | complete dissolution after 7 minutes. |

EXAMPLE 5

The advantages of providing silicic acid precipitated in situ, with respect to the uniform and stable distribution of tensides in liquid concentrates containing builders, over solutions containing no silicic acid is apparent from a comparison of the solutions and dispersions having the following compositions (all percentages are percent by weight):

Solution (a)

7% sodium sulfate;

-continued

4% nonylphenol + 14 EO;
89% water.

Solution (b)

8% trisodium phosphate;
5% nonylphenol + 14 EO;
87% water.

Solution (c)

13% sodium sulfate;
4% nonylphenol + 14 EO;
0.03% stabilizer (xanthan);
remainder water.

Solution (d)

11% trisodium phosphate;
5% nonylphenol + 14 EO;
0.05% stabilizer (xanthan);
remainder water.

Dispersion (e)

18% silicic acid precipitated in situ;
4% nonylphenol + 14 EO;
13% sodium sulfate;
1% disodium hydrogenphosphate;
0.03% stabilizer (xanthan);
remainder water.

Dispersion (f)

20% silicic acid preciptated in situ;
5% nonylphenol + 14 EO;
11% trisodium phosphate;
0.05% stabilizer (xanthan);
remainder water.

TABLE 1

| Builder Salt Concentration Composition | (wt. %) | Silicic Acid Present | Stability at Room Temperature |
|---|---|---|---|
| Solution (a) | 7% | No | stable solution; maximum salt content |
| Solution (b) | 8% | No | stable solution; maximum salt content |
| Solution (c) | 13% | No | separation after 2 hours |
| Solution (d) | 11% | No | separation after 2 hours |
| Dispersion (e) | 14% | Yes | no separation after 12 months |
| Dispersion (f) | 11% | Yes | no separation after 12 months |

As is clearly shown in Table 1, in the presence of tensides (nonylphenyl + 14 EO) only limited builder salt concentrations could be used to obtain a silicic acid-free solution which remained stable at room temperature. In marked contrast thereto, tensides in dispersions (e) and (f) were homogeneously distributed, even at significantly higher builder salt concentrations, and the dispersions remained storage-stable for periods of at least one year.

EXAMPLE 6

The advantatages of providing silicic acid precipitated in situ, with respect to the uniform and stable distribution of tensides in liquid concentrates containing builder salts, over conventional silicic acid prepared by acid precipitation is apparent from a comparison of the dispersion (f) of Example 5 with a dispersion having the following composition (all percentages are percent by weight):

20% precipitated silicic acid FK 320 (Degussa);
5% nonylphenol + 14 EO
11% trisodium phosphate;
0.05% stabilizer;
remainder water.

This dispersion demonstrated measurable separation after only two months; at the concentrate surface the separation of the wetting agent was clearly visible.

In comparison thereto the dispersion (f) of Example 5 was still homogeneous even after a storage period of 12 months, with no separation observed.

EXAMPLE 7

Formulation and Use of a Two-Component Cleaner

Greased deep-drawn steel parts stored for three months were degreased using an alkaline cleaning solution I prepared with a concentrate component B in accordance with the present invention and, in comparison thereto, a similar alkaline cleaning solution II prepared from a powdered cleaner.

The cleaning solutions had the following compositions (all percentages are percent by weight):

Cleaning solution I:

25 g/l of a silicic acid dispersion having the following composition:

20% $SiO_2$,
10% $Na_3PO_4$,
6% nonylphenol + 14 EO,
1% stabilizer (xanthan),
remainder water;

and 50 g/l of a 50% sodium hydroxide solution.

Cleaning solution II:

50 g/l of a powdered cleaner having the following composition:

20% sodium metasilicate,
5% $Na_3PO_4$,
25% sodium hydroxide,
47% sodium carbonate,
3% nonylphenol + 14 EO.

The cleaning solutions I and II, having identical concentrations of active ingredients (50 g/l), each had at 80° C. a cloud point temperature of 62° C. The time required for complete degreasing was 12 minuts with the freshly prepared cleaning solution I and 13 minutes with the freshly prepared cleaning solution II.

As is clearly shown in the following Table 2, storage for up to 12 weeks had no influence on either the degreasing time or the cloud point temperature of cleaning solution I prepared according to the present invention.

On the other hand, the properties of cleaning solution II prepared from the powdered cleaner changed continuously during the same storage period. The nonionic tensides contained in solution II degraded in the presence of the caustic alkali and oxygen in the air producing anionic tensides. The degradation of the nonionic tensides was directly associated with an increase in the foamability of solution II, which is particularly troublesome in spray cleaning solutions.

TABLE 2

| Solution | Storage Period (weeks) 1 | 4 | 12 |
|---|---|---|---|
| I Degreasing Time (min) | 12 | 12 | 12 |
| Cloud Point Temperature (°C.) | 62 | 62 | 62 |
| II Degreasing Time (min) | 13 | 16 | 21 |
| Cloud Point Temperature (°C.) | 62 | 80 | 95 |

Although the present invention has been described in terms of a number of specific examples and embodiments thereof, it will be appreciated by those skilled in the art that a wide variety of equivalents may be substituted for the specific parts and steps of operation described herein, all without departing from the spirit and scope of the present invention, as defined in the appended claims.

What is claimed is:

1. In a method for manufacturing a two-component alkaline cleaner composition having a pH greater than 11, said composition comprising a mixture of component (A) a strongly alkaline alkali metal hydroxide solution, and component (B) an aqueous silicic acid dispersion concentrate containing an anionic, nonionic or amphoteric tenside, a detergent builder, and a stabilizer, the improvement comprising forming said silicic acid in situ in said concentrate dispersion by precipitating it from an alkali metal silicate maintained at a pH of about 8 to 11, which is reacted at least one (a) mineral acid or (b) gas which reacts acidically in said silicate solution; and mixing said components.

2. The method of claim 1, wherein the silicic acid is precipitated from the alkali metal silicate solution in the presence of said tenside.

3. The method of claim 1, wherein the alkaline metal silicate solution comprises a concentrated water glass solution having an $SiO_2/M_2O$ ratio in the range of from 2 to 3.5, wherein M represents an alkali metal selected from the group consisting of Na, K and mixtures thereof.

4. The method of claim 1, wherein component A is present in a sufficient amount by weight to adjust the pH of the cleaner composition to the indicated pH, after said components are mixed.

5. The method of claim 1, wherein the mineral acid is present and is concentrated sulfuric acid, phosphoric acid or a mixture thereof.

6. The method of claim 5, wherein said mixture is present and contains sulfuric acid and phosphoric acid in a weight ratio of from 3:1 to 1:3.

7. The method of claim 1, wherein at least part of said tenside is added after said precipitation.

8. The method of claim 6, wherein the mixture contains 98% sulfuric acid and 85% phosphoric acid in a weight ratio of about 1:1.

9. The method of claim 1, wherein the gas reacting acidically in an aqueous solution is present and is hydrogen chloride, sulfur dioxide, carbon dioxide or a mixture thereof.

10. The method of claim 9, wherein the gas is carbon dioxide.

11. The method of claim 1, wherein the silicate solution in the presence of a detergent builder having a buffering capability selected from the group consisting of alkali metal orthophosphates, alkali metal polyphosphates, alkali metal carbonates, alkali metal borates, alkali metal sulfates and mixtures thereof.

12. The method of claim 11, wherein the buffering detergent builder is an alkali metal polyphosphate.

13. The method of claim 1, including the additional step of adding a further tenside, selected from the group consisting of anionic, nonionic and amphoteric tensides, to the silicic acid dispersion.

14. The method of claim 1, wherein at least part of said stabilizer is added after said precipitation and is a vegetable gum, a copolymer of a polyalkylvinyl ether and a carboxylic acid anhydride, or a mixture thereof.

15. The method of claim 14, wherein said vegetable gum is present and is xanthan.

16. The method of claim 1, wherein at least part of said detergent builder is added after said precipitation and is an alkali metal orthophosphate, alkali metal polyphosphate, alkali metal carbonate, alkali metal borate, alkali metal sulfate, or a mixture thereof.

17. The method of claim 1, wherein at least part of said tenside is added after said precipation.

18. The method of claim 1, wherein at least one of additional mineral acid, a complexing agent, or a preservative, is added to said component B.

* * * * *